US005784089A

United States Patent [19]

Crawford

[11] Patent Number: 5,784,089

[45] Date of Patent: Jul. 21, 1998

[54] MELT PLATE DESIGN FOR A SOLID INK PRINTER

[75] Inventor: Clark W. Crawford, Wilsonville, Oreg.

[73] Assignee: Tektronix, Inc., Wilsonville, Oreg.

[21] Appl. No.: 612,148

[22] Filed: Mar. 7, 1996

[51] Int. Cl.[6] ..... B41J 2/175

[52] U.S. Cl. ..... 347/88

[58] Field of Search ..... 347/88, 99

[56] References Cited

U.S. PATENT DOCUMENTS

| | | | |
|---|---|---|---|
| 4,593,292 | 6/1986 | Lewis | 347/88 |
| 4,609,924 | 9/1986 | De Young | 346/1.1 |
| 4,682,185 | 7/1987 | Martner | 346/140 |
| 4,682,187 | 7/1987 | Martner | 346/140 |
| 4,870,430 | 9/1989 | Daggett et al. | 346/140 |
| 5,276,468 | 1/1994 | Deur et al. | 347/88 |
| 5,406,315 | 4/1995 | Allen et al. | 347/88 |
| 5,442,387 | 8/1995 | Loofbourow et al. | 347/88 |
| 5,510,821 | 4/1996 | Jones et al. | 347/88 |

*Primary Examiner*—Stuart N. Hecker
*Attorney, Agent, or Firm*—Ralph D'Alessandro

[57] ABSTRACT

An improved solid ink stick melt plate design is provided for a solid ink color printer which reliability melts solid ink sticks on demand fed from an ink stick loading bin to ink stick melt plates. The melt plates guide the molten ink into individual color ink reservoirs in the printer print head. The improved melt plate design employs a positive temperature coefficient resistor to prevent the melt plate temperature from becoming too high when not in contact with an ink stick.

3 Claims, 3 Drawing Sheets

MELT PLATE DESIGN FOR A SOLID INK PRINTER

FIELD OF THE INVENTION

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape coded openings that fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later more successful solid ink printers, such as the Tektronix Phaser™ III, the Tektronix Phaser™ 300, and the Jolt printer offered by Dataproducts Corporation, used differently shaped solid ink sticks that were either gravity fed or spring loaded into a feed chute and pressed against a heater plate to melt the solid ink into its liquid form. These ink sticks were shape coded and of a generally small size. One system utilized an ink stick loading system that initially feeds the ink sticks into a preload chamber and then loads the sticks into a load chamber by the action of a transfer lever. These ink stick feed systems melted the entire supply of ink, requiring all of the molten ink to be kept at an elevated temperature for extended periods of time to maintain the molten state, thereby tending to cause the molten ink to degrade over time from being maintained at the elevated temperature. Earlier solid or hot melt ink systems used a flexible web of hot melt ink that is incrementally unwound and advanced to a heater location or vibratory delivery of particulate hot melt ink to the melt chamber.

As phase change ink color printers have increased their printing speed the need has developed to provide larger sized ink sticks so that refill of the ink reservoir in the print head is less frequent and more output or prints can be produced between refills. In designs where there is not a steep or generally vertical feed path to the heater plate, some provisions have been made to prevent the solid masses of shaped ink from sticking to the sides of the feed chutes so that an unrestricted feed of ink sticks proceed down into the heater plate for melting and filling of the individual colored ink reservoirs that are usually located within the print head. These larger sized ink sticks are fed into receptacles or openings in a cover plate over the feed chutes. If an ink stick is inadvertently inserted within the wrong receptacle it can be difficult for the printer operator to remove the ink stick, especially because of the sticky nature of the ink sticks' waxy exterior surfaces that can cause them to become wedged in the incorrect ink stick receptacle. There is a need to provide effect and efficient way to feed a plurality of ink sticks in an ink stick feed bin to melt plates for melting to feed into the individual colored ink reservoirs. There is also a need to feed only the amount of molten ink that is needed for printing, or to melt the solid ink on demand.

In solid ink printers the absence of a temperature limiter for the heater melting the solid ink, the melt plate surface temperature in absence of contact with the ink block or stick can reach several hundred degrees Centigrade or in excess of 300° C. This will result in hazardous user accessible temperatures, generation of smoke from the burning of the residual ink on the heater and the possible melting of any supporting plastic hardware for the heater.

These problems are solved in the design of the present invention by providing an improved solid ink stick melt plate design that has a plurality of solid ink sticks guided down a plurality of individual ink stick feed chutes to heated melt plates which melt the lead solid ink sticks on demand and deliver the melted ink to individual colored ink reservoirs where the minimum quantity of ink is maintained in a heated state until jetting by the print head.

SUMMARY OF THE INVENTION

It is an aspect of the present invention to provide an improved ink stick feed system for a solid ink printer that prevents or substantially reduces jamming of the ink sticks in the individual feed chutes.

It is another aspect of the present invention to provide an improved ink stick feed system that provides ink sticks to the heated melting plates on demand to melt ink as it is needed for printing.

It is still another aspect of the present invention to provide an improved ink stick feed system which senses a low ink supply state and an empty ink supply state in the individual ink stick feed chutes to assist the printer operator in knowing when to replenish the ink stick supply.

It is a feature of the present invention that the individual ink stick feed chutes within the ink stick feed bin guide the individual solid ink sticks to the heated melt plates for melting and delivery of the molten ink into the heated individually colored liquid ink reservoirs.

It is another feature of the present invention that ink sticks are pushed towards the individual melt plates by use of constant force springs acting on a block within each ink feed chute.

It is still another feature of the present invention that the constant force springs used to advance the ink sticks in the individual ink feed chutes retract when the feed cover is raised to permit ink sticks to be loaded into the individual ink feed chutes in the ink stick feed bin.

It is an advantage of the present invention that the improved ink stick feed system provides an efficient and simple way of providing ink sticks to the heated melt plates to insure a continuous supply of molten ink for printing.

It is another advantage of the present invention that replenishing the solid ink supply in the printer is simple and easily accomplished by the printer operator.

It is a further advantage of the present invention that the loading of the ink sticks and the feeding of the ink into the individual color is simplified.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

The improved ink feed assembly of the present invention is designed to automatically feed wax based ink, molded in generally a block form, into integral melt plates 29A–D for replenishment of the melted ink volume in the reservoirs used in the solid ink color printer 10.

Figure 1:
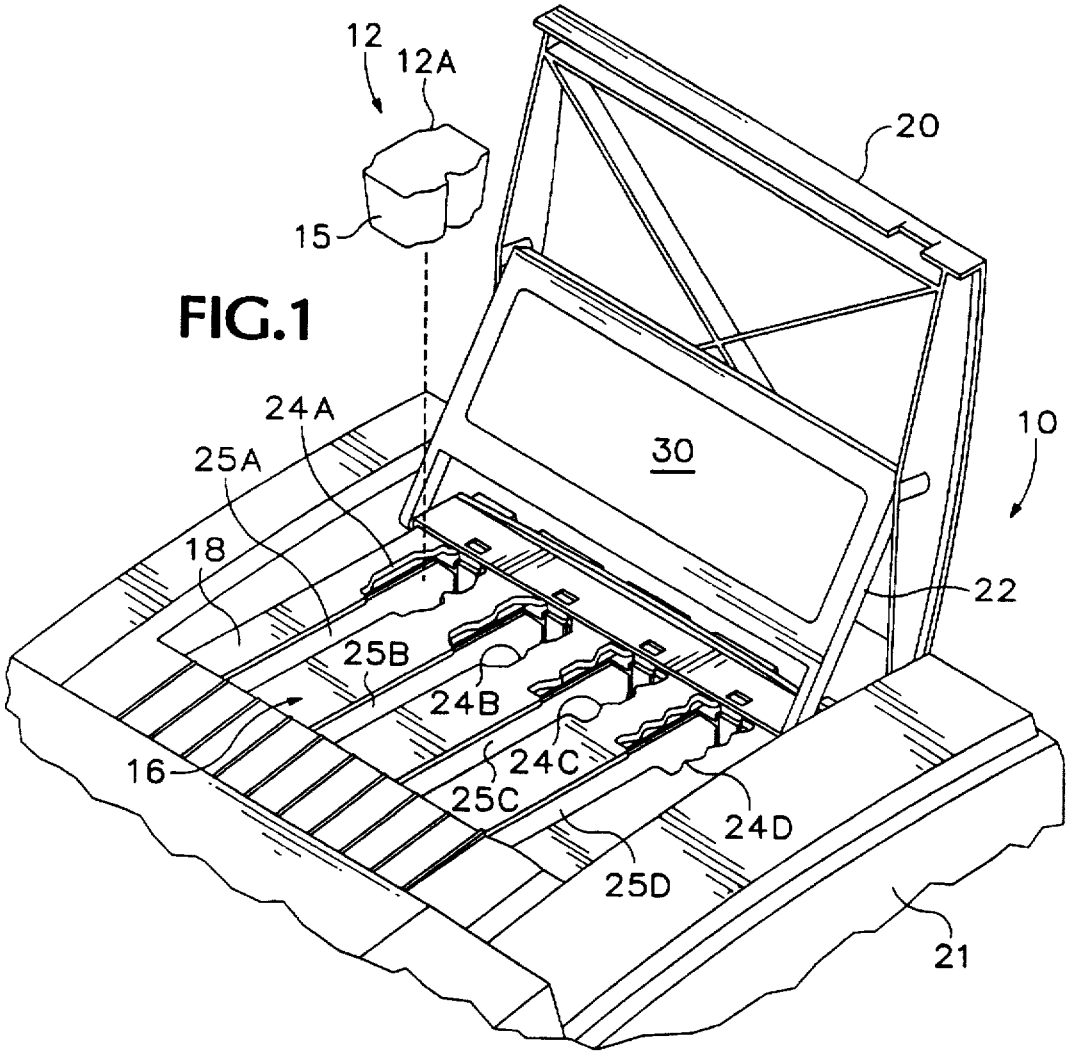
FIG. 1 is an enlarged partial top perspective view of the color printer with the solid ink stick feed bin cover and printer cover open showing a solid ink stick in position to be loaded into the appropriate ink stick receptacle.

FIG. 1 discloses a portion of a solid ink stick printer, indicated generally by the numeral 10, with the printer top cover 20 raised so that the attached ink stick feed cover 30 is also raised, disclosing the ink stick loading bin with the key plate 18 positioned within the printer sidewalls 21. The feed cover 30 is pivotally mounted to the yoke 17 that is connected to the ink stick loading bin assembly 16 adjacent the printer side frames 21 by pivot arms 22 of FIGS. 1 and pivot pins 23 (see FIG. 2). An ink stick feed front cover plate or yoke 17 is mounted to the ink stick loading bin atop of the key plate 18 for sliding movement along the top of the key plate 18 to assist in moving the individual ink sticks 12A–D, indicated generally in FIG. 1 by the numeral 12, forward in the feed chutes 25A–D toward the melt plates 29A–D of FIGS. 2 and 3.

Ink sticks 12A–D are inserted into the appropriately shaped receptacles or openings 24A–D in the key plate 18 of the ink stick loading bin 16 to feed the solid ink sticks down the corresponding ink stick feed chutes 25A–D to the melt plates 29A–D which melt the ink and feed it into the individual ink color reservoirs within the print head (not shown) of the printer 10. The ink sticks 12A–D consist of the four primary colors of cyan, yellow, magenta and black, each having its own distinctive shape with a correspondingly shaped opening or receptacle 24A–D being provided in the key plate 18 to help ensure that the correct colored ink stick 12A–D is loaded into the appropriate and corresponding ink stick feed chute 25A–D to prevent color contamination of the inks in the individual color reservoirs (not shown) in the print head (also not shown), both of which are described in detail in co-pending U.S. patent application Ser. No. 08/610,564 entitled "High Performance Ink Jet Print Head Having An Improved Ink Feed System", filed Mar. 6, 1996.

The ink sticks 12A–D are generally tapered from their top downwardly and inwardly to their bottom. The top and bottom of each stick 12 is connected by the tapered sides and may have an upper flared portion. The opposing end portions 15, only one of which is best shown in FIG. 1, have a semi-protruding nose portion in the center of each end to prevent or minimize jamming due to wedging along the sides of the appropriate individual ink stick feed chute 25A–D.

Each chute 25A–D preferably can have a pair of shoulders and a bottom channel into which the properly inserted ink stick 12 should extend to permit it to be fed the length of the appropriate chute 25A–D to the melt plate 29. A friction reducing material (not shown), such as a felt or polyester fiber, may be employed to facilitate sliding of the ink sticks down the appropriate chute 25A–D.

Figure 2:
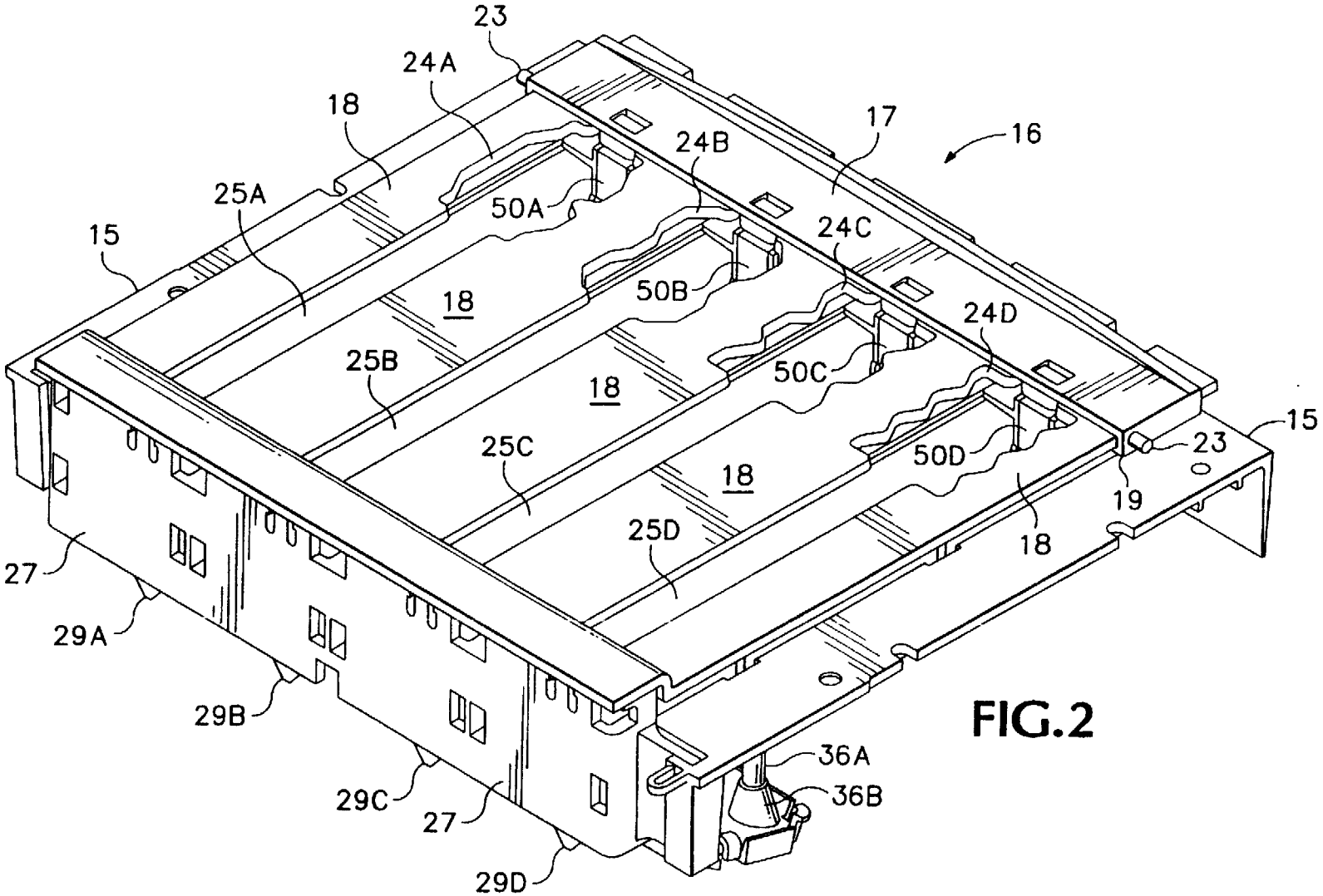
FIG. 2 is a top perspective view of the key plate assembly and the melt plate assembly that are part of the ink stick feed bin.
Figure 3:
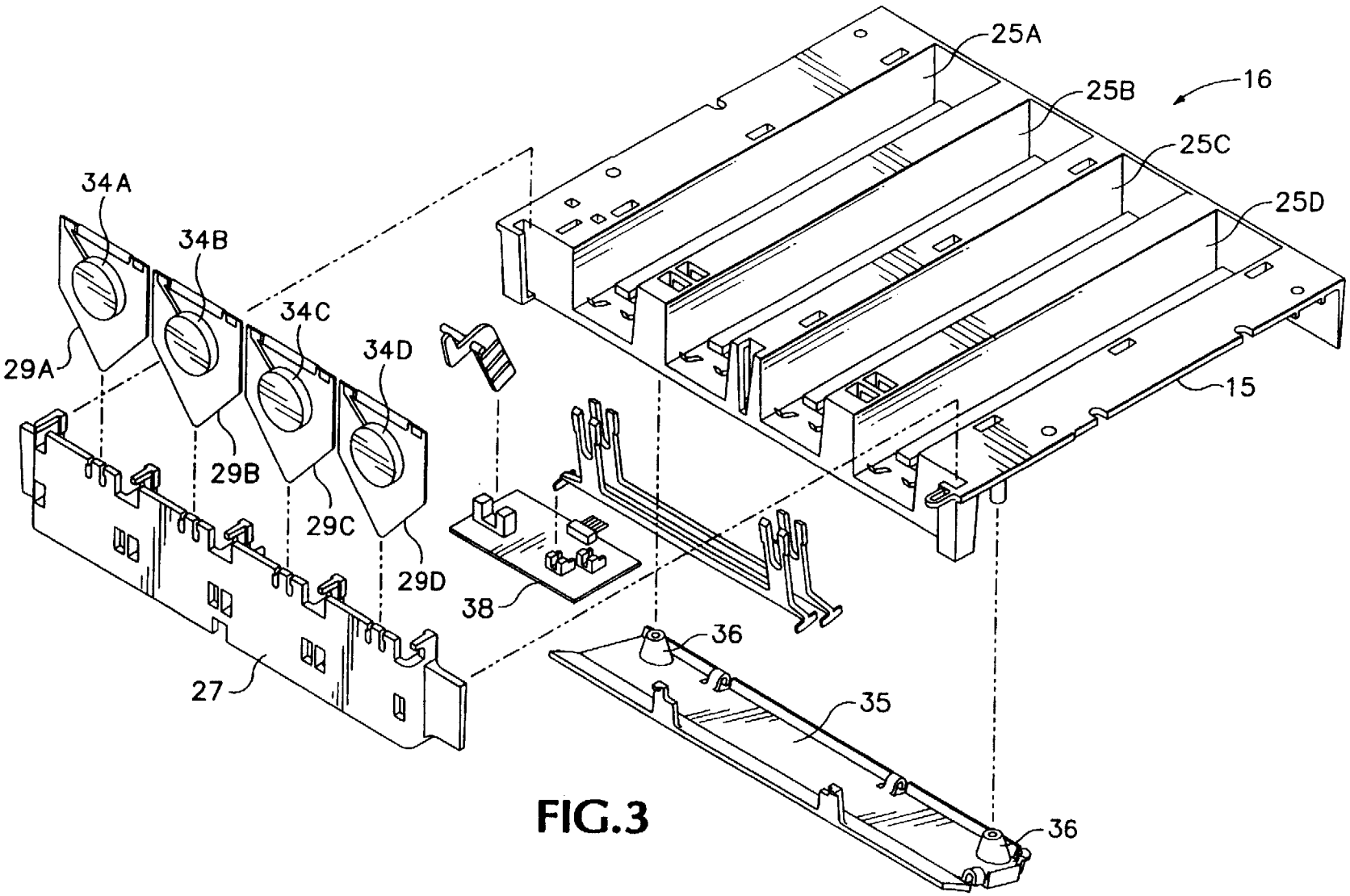
FIG. 3 is an exploded view of the solid ink stick feed bin and melt plate assembly showing movement the relationship of the melt plates to the ink stick feed chutes in the ink stick feed bin.

The ink stock loading bin 16 holds four ink colors, each color stick 12A–D is similar in volume and has a distinctive shape. The main body of the loading bin 16 has four ink stick feed chutes 25A–D, as seen in FIGS. 2–3, accommodating four rows of three plus ink sticks 12A–D, nested horizontally, end to end. The walls of the individual feed chutes 25A–D have a specific transition angle, allowing only minimal contact with the ink sticks 12A–D while guiding them to the melt plates 29A–D. Every color is assigned a specific chute 25A–D. The colors have a unique shape in the top-bottom cross section and will only fit through the matching keyed opening or receptacle 24A–D in the ink stick feed bin top plate or key plate 18. Keying makes accidental mixing of the ink stick colors improbable.

Preloading of each individual chute 25A–D with ink is facilitated by use of a constant force springs (not shown) acting on push blocks 50A–D which push the individual ink sticks 12A–D toward the melt plates 29A–D, as seen in FIG. 2. The springs 54 are wound on freely rotating drums (not shown) housed in the push blocks. Loading and feeding of the ink sticks 12 can cause flakes and particles of ink to be drawn by gravity to the bottom of the ink stick feed chutes 25A–D. The springs 54 are positioned at the top of the chutes 25A–D to help keep the chutes free of ink debris. Placement of the springs 54 at the top necessitates retracting the springs when loading ink sticks 12 into the ink stick loading bin 16.

The ink stick loading bin 16 is covered by key plate 18 which acts to protect the ink sticks 12, contributes to the printer aesthetics, helps support the paper output tray and simplifies ink stick 12 insertion. A bail and yoke configuration couples the four independent push blocks 50A–D through the constant force springs to the ink stick feed cover 30. The anchored end of the springs are attached to yoke 17 which is connected to the cover 30 through a pair of pivoting bails or arms 22 of FIG. 1 mounted about pivot pins 23 of FIG. 2. The ends of the yoke 17 are held by the key plate 18 in a track 19 such as to provide a linear slide along the opposing sides of key plate 18.

Lifting the printer top cover 20 and, therefore, the articulated ink stick feed cover 30 forces the ink push blocks 50, best seen in FIGS. 1 and 2, back to a clear position shown in FIG. 2, allowing ink sticks 12A–D to be inserted through the keyed openings or receptacles 24A–D in front of the blocks 50. When open, full length slots 25'A–D in the key plate 18 make it easy to assess the remaining ink supply for all ink stick 12 colors. Closing the printer cover 20 causes the push blocks 50 to apply a force through the push block flat front surfaces against the ink sticks 12A–D that is directed toward the melt plates 29A–D. the ink stick load bin 16 is described in detail in co-pending U.S. patent application Ser. No. 08/612,149 entitled "Ink Supply Assembly", filed Mar. 7, 1996.

Melt plates 29A–D are made of alumina and use thick film resistor material for heaters. A positive temperature coefficient resistor (PTC device) 34, commercially available from the Siemens Component Division of Siemens Corporation in Portland, Oregon as part A598108160-A10, in series with the thick film resistor, is used to limit the current so that the heater cannot rise above an acceptable free air temperature. The PTC device 34 is preferably about a 25 millimeter round disk that is about 2.6 millimeters thick utilizing a chromium nickel gold electrode to achieve a sharp increase in resistance and therefore temperature at the desired temperature.

A melt plate adapter assembly 27, which positions and retains the melt plates 29A–D offset a desired distance from the ink stick feed chutes 25A–D, mounts to the ink stick loading bin 16 and functions as a safety barrier against high temperature and voltage by enclosing the top, front and sides of the melt plate area. The bottom of the melt plates 29A–D, which protrude below the melt plate adapter assembly 27 (see FIG. 2 briefly) are angled at controlled drip location for the melted ink 13 to direct the molten ink downwardly into the appropriate reservoir. The offsetting of the melt plates 29A–D permits the molten ink to run down the inner surface of the melt plates 29A–D and not back up into the individual ink stick feed chutes 25A–D. An appropriately materialed deflector plate 33, such as aluminum, is affixed to the bottom of the ink stick loading bin 16 to help dissipate any heat that may build up from the melt plates 29A–D in the ink stick loading bin 16. A similar heat deflector shield 35 (see FIG. 3) is provided for the same purpose to protect the circuit board 38 for the ink supply status sensors 39 and 40.

The method employed for temperature control limit is the use of a positive temperature coefficient resistor material (PTC) 34 heat sunk to the heater and in series with the heater electrically. The PTC 34 resistance is highly non-linear with temperature. At normal operating temperature with ink sticks 12 in contact and melting and dripping away from the heater, the PTC 34 runs at a fairly constant 140° C. At this temperature the resistance of the PTC 34 is insignificant and the PTC 34 is effectively a shunt allowing current flow through the heater. Upon loss of contact between the heater and an ink stick 12, ink dripping stops and the energy input to the heater is not carried away by the melting and dripping ink. This results in the heater melt plate 29 temperature rising. As the PTC 34 temperature rises above its transition temperature the resistance of the PTC 34 increases several orders of magnitude and becomes the dominate resistance in the circuit. The high resistance of the PTC 34 causes a decrease in the current flow and a corresponding decrease in the heat energy being dissipated in the heater/PTC combination. In the tripped state the heater plate temperature is limited to about 180° C. The PTC is self resetting once the thermal lead represented by the ink stick 12 and melting ink is returned to contact with the heater.

Figure 4:
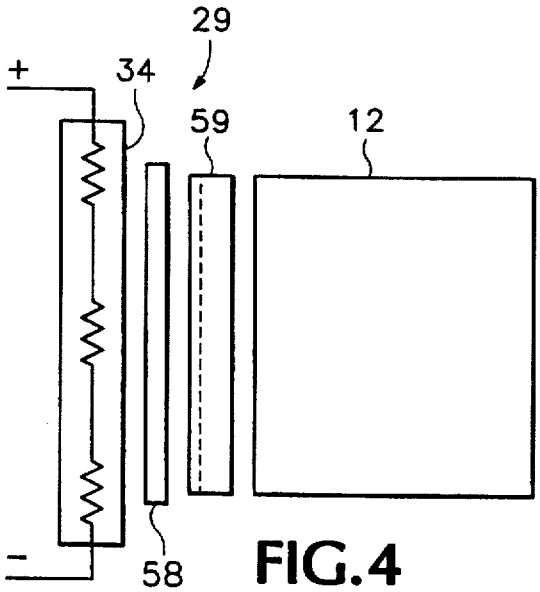
FIG. 4 is a diagrammatic illustration of the melt plate assembly.

The PTC 34 is comprised of a Kapton insulator 58, illustrated in FIG. 4, between the ceramic heater plate and the aluminum wing plate 59. This Kapton insulator 58 provides electrical isolation between the heater runs and the metallic wing plate 59. Use of about 1 mil thick layers of Kapton can withstand greater than 3.5 KU of electrical potential. The Kapton insulator 58 layer's thermal insulation properties help increase and control the temperature of the ink dripping from the melt plates 29. It is desired to drip the molten ink 13A into the print head reservoir at the reservoir's operational temperature to avoid quenching the ink reservoir from an ink filling sequence. The Kapton insulator 58 causes the heater plate 29 to operate at about 140° C. and allows the molten ink to reach this heater temperature before dripping into the reservoir. Without the layer of Kapton insulation 58 in place, the ink would rip at close to the melting point of the ink or at about 105° C. and nearly independent of the wattage applied to the heater due to phase change. The thickness of the layer of Kapton insulation 58 is determined by the wattage of the heater, the Kapton thermal conductivity, the desired heater plate temperature and the melting temperature of the ink. A preferred thickness is about 2 mils.

Flow of the molten ink 13 is determined primarily by the temperature of the heated melt plate 29 surface. In order to control the speed and direction of the molten ink flow front, the specifically configured Kapton insulator film is positioned on the ink stick side of the resistance heater. The insulation 58 enables the melt plate area surrounding the ink sticks 12 to become hotter than the area in contact with the ink. Because the temperature of melted ink 13 rises as it spreads onto the melt plate 29, it thins enough to efficiently run down under force of gravity and drip off of the tip of the plates 29, as opposed to spreading in an undesired fashion. The insulation material 58 allows the melted ink 13 on the melt plates 29 to reach a desirable temperature before dripping off of the individual plates without having to raise the whole melt plate 29 to an undesirably high temperature. The temperature difference between the insulation material 58 and the individual melt plates 29 provides the benefit so that as the ink stick 12 front stops melting when the heaters are turned off, the melted ink 13 remaining on the top, sides and bottom of the plate 29 continues flowing off of the plate, leaving the individual plates free of all but a very thin film of ink.

The melt plate 29 heater is fabricated from alumina ceramic using hybrid thick-film screen printing and firing techniques. This heater construction provides a high temperature heater greater than 300° C. and is cost effective.

The aluminum wing plate 59 has been configured to contain the melting ink and to eliminate the possibility of the molten ink coming into contact with the support structure at the edges of the melt plate 29, possibly leading to a gradual build-up of stalactites/stalagmites of solidified ink. Such a build-up could eventually jam the ink sticks 12 and prevent contact of the ink stick with the heater, causing a failure of the ink stick loading bin to deliver ink to the reservoir when called upon to do so.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A solid ink stick feed system selectively permitting ink sticks of a predetermined shape to be fed into a printer and not permitting improperly shaped or improperly oriented ink sticks to be fed, the system comprising in combination:

a. an ink stick feed bin having areas for receipt of a plurality of ink sticks, the ink sticks having a plurality of distinctive shapes, the areas accepting ink sticks that are only oriented correctly;

b. a cover for the ink bin, the cover having a plurality of receptacles corresponding to the plurality of distinctive ink stick shapes and each receptacle matched to a predetermined ink stick shape c. spring loaded push means to guide the plurality of ink sticks through the areas of the ink stick feed bin; and d. heater means adjacent the ink stick feed bin areas positioned to receive individual ink sticks guided thereto by the push means to melt the ink sticks on demand and guide the molten ink to collection means separated according to a distinctive color quality of the ink, the heater means further employing a positive temperature coefficient resistor.

2. The apparatus according to claim 1 further comprising the positive temperature coefficient resistor being separated from a melt plate by an insulator material.

3. The apparatus according to claim 2 further comprising the melt plate being formed from a metallic material.

* * * * *